US006565402B2

(12) United States Patent
Yamauchi et al.

(10) Patent No.: US 6,565,402 B2
(45) Date of Patent: May 20, 2003

(54) CATHODE, METHOD FOR MANUFACTURING THE CATHODE, AND PICTURE TUBE

(75) Inventors: Masahide Yamauchi, Osaka (JP); Satoru Nakagawa, Osaka (JP); Yoshikazu Iwai, Osaka (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 0 days.

(21) Appl. No.: 09/952,293

(22) Filed: Sep. 10, 2001

(65) Prior Publication Data

US 2002/0045398 A1 Apr. 18, 2002

Related U.S. Application Data

(62) Division of application No. 09/157,726, filed on Sep. 21, 1998, now Pat. No. 6,351,061.

(30) Foreign Application Priority Data

Sep. 26, 1997 (JP) ..... 9-279733

(51) Int. Cl.[7] ..... H01J 9/02
(52) U.S. Cl. ..... 445/46; 445/50; 445/51
(58) Field of Search ..... 445/46, 50, 51; 313/346 R, 346 DC, 337

(56) References Cited

U.S. PATENT DOCUMENTS

| | | | | |
|---|---|---|---|---|
| 2,878,409 A | | 3/1959 | Levi | |
| 3,238,596 A | * | 3/1966 | Rich et al. | 445/24 |
| 3,257,703 A | * | 6/1966 | Coad et al. | 445/24 |
| 3,623,198 A | | 11/1971 | Held | |
| 3,879,830 A | | 4/1975 | Buescher | |
| 4,400,648 A | | 8/1983 | Taguchi et al. | |
| 4,478,590 A | | 10/1984 | Rychlewski | |
| 4,957,463 A | | 9/1990 | Branovich et al. | |
| 4,980,603 A | | 12/1990 | Kimura et al. | |
| 5,122,707 A | | 6/1992 | Nakanishi et al. | |
| 5,808,404 A | | 9/1998 | Koizumi et al. | |
| 5,982,083 A | | 11/1999 | Ju et al. | |

FOREIGN PATENT DOCUMENTS

| | | |
|---|---|---|
| DE | 1 098 621 | 2/1961 |
| DE | 28 08 134 | 8/1979 |
| EP | 0052047 | 5/1982 |
| EP | 0 831 512 | 3/1998 |
| JP | 44-10810 | 5/1969 |
| JP | 50-103967 | 8/1975 |
| JP | 58-34539 | 3/1983 |
| JP | 58-87735 | 5/1983 |
| JP | 5-74324 | 3/1993 |
| JP | 6-103885 | 4/1994 |
| JP | 6-111711 | 4/1994 |
| JP | 7-105835 | 4/1995 |

* cited by examiner

*Primary Examiner*—Kenneth J. Ramsey
*Assistant Examiner*—Joseph Williams
(74) *Attorney, Agent, or Firm*—Merchant & Gould, P.C.

(57) ABSTRACT

A cathode structure comprises a cylindrical metal sleeve having aperture portions at both ends, a base metal having an aperture portion on one end, which is fitted onto one of the aperture portions of the metal sleeve, and an electron-emitting layer, which is formed on a flat portion of an outside surface of the base metal. After an electron-emitting material is sprayed onto the base metal, its surface is mechanically flattened to form the electron-emitting layer. Thus, the planarity of the surface of the electron-emitting layer can be improved without deterioration of the electron emission characteristics and the moiré can be decreased without reduction of the resolution.

5 Claims, 13 Drawing Sheets

CATHODE, METHOD FOR MANUFACTURING THE CATHODE, AND PICTURE TUBE

This application is a divisional of U.S. patent application Ser. No. 09/157,726, filed Sep. 21, 1998 now U.S. Pat. No. 6,351,061.

FIELD OF THE INVENTION

The present invention relates to a cathode for use in a picture tube, a manufacturing method therefor, and to a picture tube using the cathode.

BACKGROUND OF THE INVENTION

Conventional cathodes for color picture tubes are often oxide cathodes of a base metal coated with an oxide of an alkali earth metal such as barium, strontium, or calcium serving as the electron-emitting material. Methods frequently used for coating the base metal with the electron-emitting material include spraying a suspension of the electron-emitting material in a binder such as nitrocellulose or ethylcellulose onto the base metal.

FIG. 11 is a schematic view of a conventional oxide cathode. As is shown in FIG. 11(*a*), the cathode structure includes a cylindrical sleeve 1, a base metal 2 covering one of the aperture portions of the sleeve 1, and an electron-emitting layer 4 formed on the base metal 2. Usually, the electron-emitting layer 4 has homogeneous porosity and a suitable density for electron emission. To provide the electron-emitting layer 4 with suitable and homogeneous porosity, it is preferable that the average particle size of the crystal particles in the electron-emitting layer 4 is at least 5 μm. Here, average particle size of the crystal particles in the electron-emitting layer 4 means the average particle size of the electron-emitting crystals solidified from the binder suspension. When the average particle size of the crystal particles is more than 5 μm, the planarity of the surface of the electron-emitting layer 4 (electron-emitting surface) becomes low, as is shown in FIG. 11(*b*).

FIG. 12 shows an electrical equipotential distribution near the electron-emitting surface and a current-density distribution of the electrons emitted from the electron-emitting surface, when the planarity of the electron-emitting surface is low. Numeral 7 in FIG. 12 indicates a control electrode, and numeral 8 indicates an acceleration electrode. When the electron-emitting surface of the electron-emitting layer 4 has a low planarity and many irregularities, the electrical equipotential distribution 5 that causes the electron emission and is formed in front of the electron-emitting surface warps, and so does the current density distribution 6 of the electrons emitted from the electron-emitting surface, as is shown in FIG. 12.

When the current density distribution 6 of the electrons emitted from the electron-emitting surface warps, distortions in the brightness distribution of the electron beam spot formed on the fluorescent screen of the picture tube may occur. It is well-known that these distortions in the brightness distribution of the electron beam may result in moiré caused by the interference of the phosphorous dot arrangement and the scanning beam.

A picture tube cathode with improved planarity of the electron-emitting surface is known from Publication of Unexamined Japanese Patent Application No. Hei 5-74324. This cathode is explained with reference to FIG. 13. As is illustrated in FIGS. 13(*a*) and 13(*b*), an electron-emitting layer 9 is divided into two layers, namely a lower layer 10 adhering to the base metal 2 and an upper layer 11 formed on top of the lower layer 10. The average particle size of the electron-emitting material of the upper layer 11 is smaller than the average particle size of the electron-emitting material of the lower layer 10. By selecting an average particle size of 5 to 20 μm (for example 10 μm), the lower layer 10 can be made porous and a suitable density for electron emission can be realized. Moreover, by selecting an average particle size of less than 5 μm (for example 3 μm), the planarity of the surface of the electron-emitting upper layer 11 is improved.

However, when the electron-emitting layer is formed with this conventional technique, electron-emitting materials of two different particle sizes are necessary. And, when an electron-emitting material of less than 5 μm average particle size is used to form the upper layer of the electron-emitting layer, the porosity of the upper layer surface is lost, and it becomes difficult to attain a desired electron emission.

The present invention has been developed to overcome the problems of the prior art. It is a purpose of the present invention to provide a cathode with improved planarity of the surface of the electron-emitting layer and smooth current density distribution for the electrons emitted from the electron-emitting surface, without deterioration of the electron emission characteristics. It is another purpose of the present invention to provide a method for manufacturing such a cathode, and a picture tube using this cathode.

SUMMARY OF THE INVENTION

In order to achieve these purposes, a cathode in accordance with the present invention comprises a base metal and an electron-emitting layer of electron-emitting material formed on the base metal. A surface of the electron-emitting layer is mechanically flattened after spraying the electron-emitting material onto the base metal. In such a cathode, a porous structure is formed throughout the entire electron-emitting layer, so that a certain electron emission can be attained, the planarity of the electron-emitting surface can be improved, and the current density distribution of the electrons emitted from the electron-emitting surface can be smoothened.

It is preferable that the cathode according to the present invention further comprises an adhesive coating between the base metal and the electron-emitting layer. In this preferable example, a decrease in the adhesive force between the base metal and the electron-emitting layer caused by mechanical flattening (for example by pressing) of the electron-emitting surface can be prevented.

It is preferable that in the cathode according to the present invention, the surface of the electron-emitting layer is flattened only in a region comprising an electron-emitting region. In this preferable example, a decrease in the adhesive force between the base metal and the electron-emitting layer caused by mechanical flattening (for example by pressing) of the electron-emitting surface can be prevented.

It is preferable that the surface roughness of the surface of the electron-emitting layer (maximum height $R_y$ in JIS B 0601) in the cathode of the present invention is not more than 15 μm. In this preferable example, the current density distribution of the electrons emitted from the electron-emitting surface can be smoothened.

A method for manufacturing a cathode comprising a base metal and an electron-emitting layer of electron-emitting material formed on the base metal in accordance with the present invention comprises the steps of spraying the electron-emitting material onto a metal base to form the electron-emitting layer; and mechanically flattening an electron-emitting surface of the electron-emitting layer.

It is preferable that the method for manufacturing a cathode according to the present invention further comprises a step of injecting an adhesive coating between the base metal and the electron-emitting layer, after flattening the electron-emitting surface.

A picture tube in accordance with the present invention comprises a face panel having a phosphorous screen on an inside surface; a funnel connected to the rear of the face panel; an electron gun having a cathode in a neck portion of the funnel, the cathode comprising a base metal and an electron-emitting layer of electron-emitting material formed on the base metal, wherein a surface of the electron-emitting layer is mechanically flattened after spraying the electron-emitting material onto the base metal. As a result, the moiré caused by interference of the phosphorous dot arrangement and the electron scanning beam can be decreased.

It is preferable that the cathode in the picture tube according to the present invention further comprises an adhesive coating between the base metal and the electron-emitting layer.

It is preferable that the surface of the electron-emitting layer in the picture tube of the present invention is flattened only in a region comprising an electron-emitting region.

It is preferable that the surface roughness of the surface of the electron-emitting layer (maximum height $R_y$ in JIS B 0601) in the picture tube of the present invention is not more than 15 $\mu$m.

BRIEF DESCRIPTION OF THE DRAWINGS

FIG. 1(*b*) shows a magnification of the electron-emitting layer in FIG. 1(*a*).

FIG. 11(*b*) is a magnification of the electron-emitting layer in FIG. 11(*a*).

FIG. 13(*b*) is a magnification of the electron-emitting layer in FIG. 13(*a*).

DESCRIPTION OF THE PREFERRED EMBODIMENTS

The following is a description of the preferred embodiments of the present invention, with reference to the accompanying drawings.

First Embodiment

Figure 1:
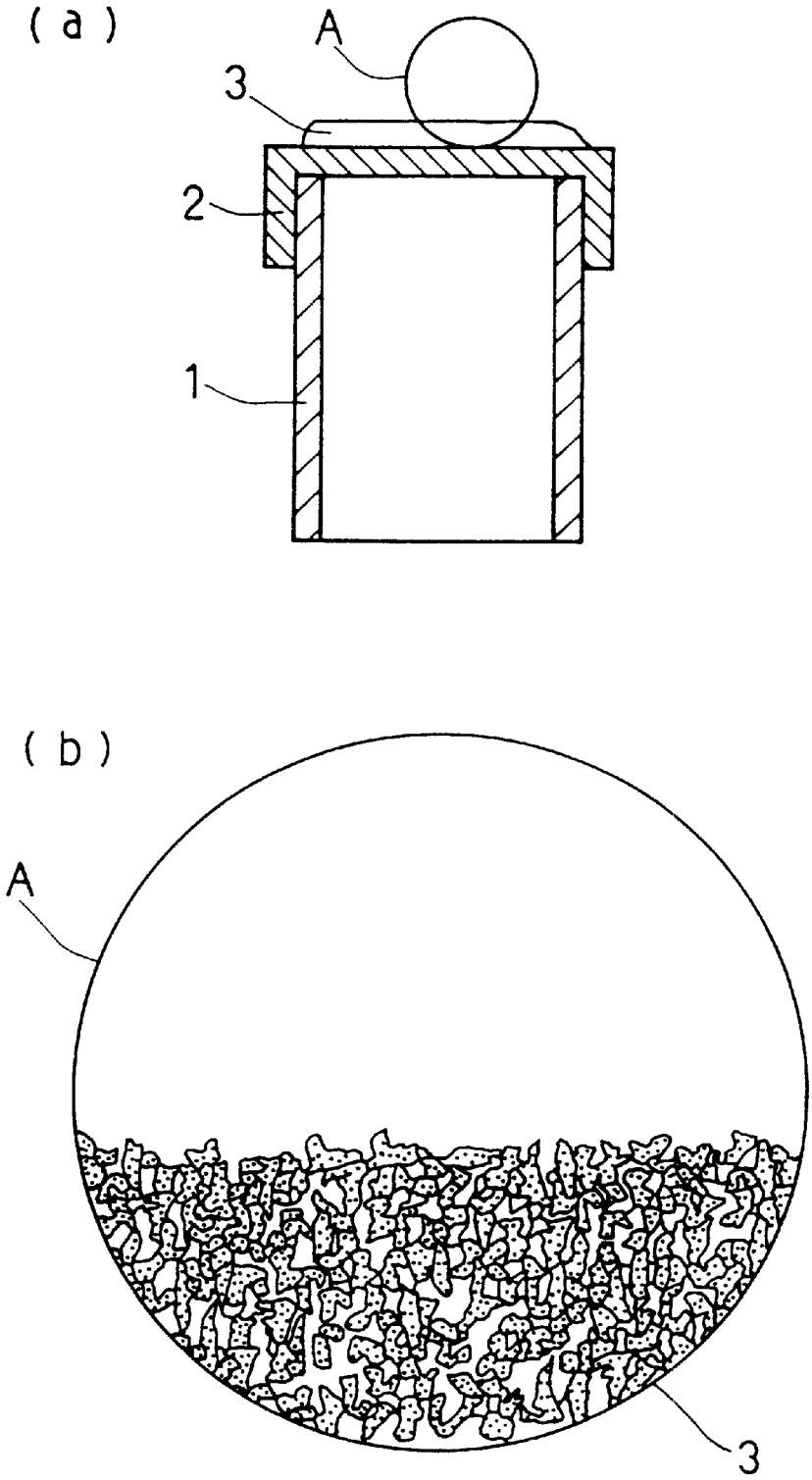
FIG. 1(*a*) is a cross-sectional view showing a cathode according to the first embodiment of the present invention.

FIG. 1(*a*) is a cross-sectional view of a cathode according to a first embodiment of the present invention. FIG. 1(*b*) is a magnified view of the electron-emitting layer in FIG. 1(*a*).

As is shown in FIG. 1(*a*), a cathode structure in accordance with this embodiment of the present invention comprises a cylindrical metal sleeve 1 having aperture portions at both ends, a base metal 2 having an aperture portion on one end, which is fitted onto one of the aperture portions of the metal sleeve 1, and an electron-emitting layer 3, which is formed on a flat portion of an outside surface of the base metal 2. A heater (not shown in the drawing) is inserted in the sleeve 1.

The main component of the base metal 2 is nickel, and it comprises reducing elements, such as silicon or magnesium. The bottom part of the base metal 2 is substantially flat. A material having alkali earth metal carbonate as a component is used for the electron-emitting material.

The electron-emitting layer 3 of this cathode structure is formed as follows: First, a carbonate powder of, for example, barium, strontium, or calcium is suspended in a binder of, for example, nitrocellulose or ethylcellulose to produce a paste for spraying. This paste for spraying is dispersed into a mist with a spray gun, and applied by spraying on the flat portion of the base metal 2. To attain favorable electron emission characteristics, the density and the thickness of the electron-emitting layer 3 are optimized by controlling the spray pressure during the spraying, spray duration, and the number of spray applications. To give an example, it is preferable that the average particle size of the electron-emitting carbonate powder is 10 $\mu$m, the thickness of the electron-emitting layer 3 is 70 $\mu$m, and its density is 0.8 g/cm$^3$.

To vaporize the binder after the spraying, the electron-emitting layer 3 is dried for about 5 min at an atmospheric temperature of about 200° C. Thus, a moderate adhesive force works among the particles of the electron-emitting material, and between the electron-emitting layer 3 and the base metal 2.

Figure 2:
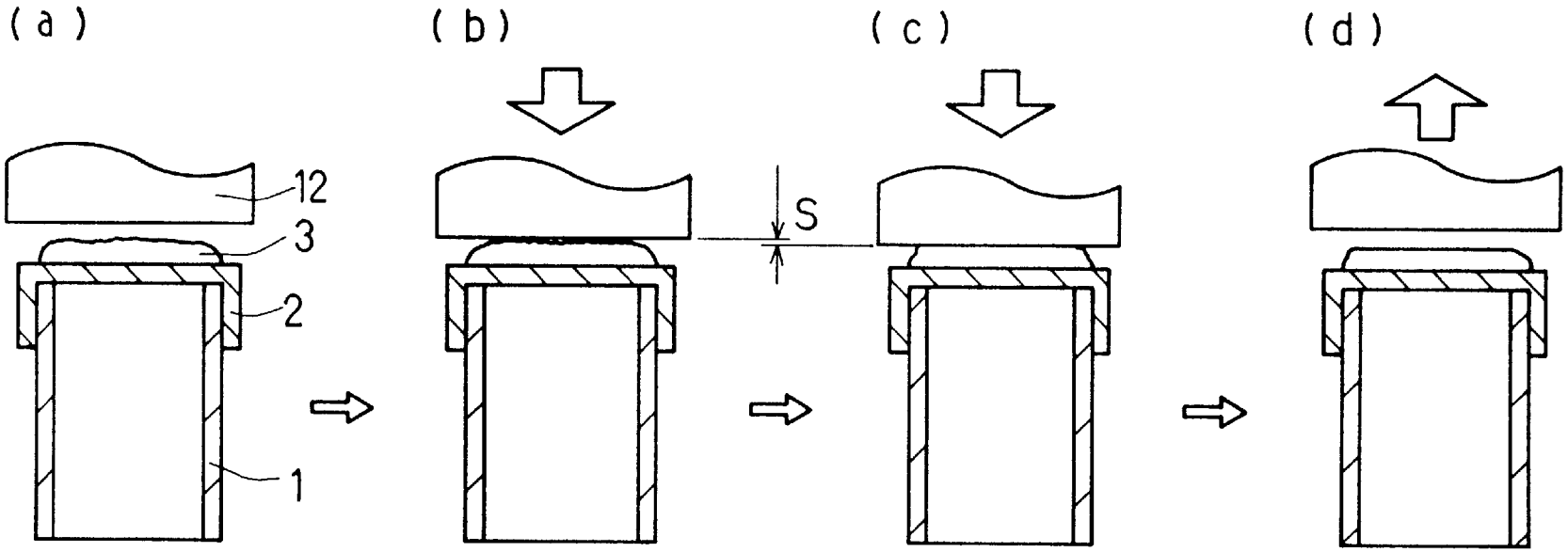
FIGS. 2(*a*)–(*d*) are cross-sectional views illustrating the steps of a method for manufacturing a cathode in accordance with the first embodiment of the present invention.

The following explains, with reference to FIG. 2, how the surface of the electron-emitting layer 3 is mechanically flattened. FIG. 2(*a*)–(*d*) are cross-sectional views illustrating the steps of a method for manufacturing a cathode in accordance with the first embodiment of the present invention.

As is shown in FIGS. 2(*a*)–(*d*), the surface of the dried electron-emitting layer 3 is compacted with a press-die 12 having a smooth surface. To attain an appropriate planarity for the surface of the electron-emitting layer 3, it is preferable that the surface roughness (maximum height $R_y$ in JIS B 0601) of the press-die 12 is not more than 2 $\mu$m.

As is shown in FIGS. 2(*b*) and (*c*), the stroke S of the press die 12 when it presses the surface of the electron-emitting layer 3 should be set to a value where the internal density of the electron-emitting layer 3 is not changed and the unevenness of the surface is flattened out. For example, it is preferable that the stroke S is about 10 $\mu$m.

The electron-emitting layer 3 formed with this method has a porous structure with suitable crevices over the entire layer, because the average particle size in the electron-emitting layer is selected to be at least 5 $\mu$m, as is shown in FIG. 1(*b*). Moreover, by pressing only a little near the surface of the electron-emitting layer 3, the surface of the electron-emitting layer 3 is flattened, but still has favorable crevices in its surface.

To obtain a smooth current density distribution of the electrons emitted from the electron-emitting surface of the electron-emitting layer 3, a favorable level of planarity of the electron-emitting layer 3 is a surface roughness (maximum height $R_y$ in JIS B 0601) of not more than 15 $\mu$m. If the surface roughness (maximum height $R_y$ in JIS B 0601) is not more than 10 $\mu$m, then an even better current density distribution can be attained.

Second Embodiment

When the electron-emitting layer 3 is pressed after drying, as explained for the first embodiment, the adhesive force between the electron-emitting layer 3 and the base metal 2 decreases, and the electron-emitting layer 3 can more easily peel off the base metal 2.

Figure 3:
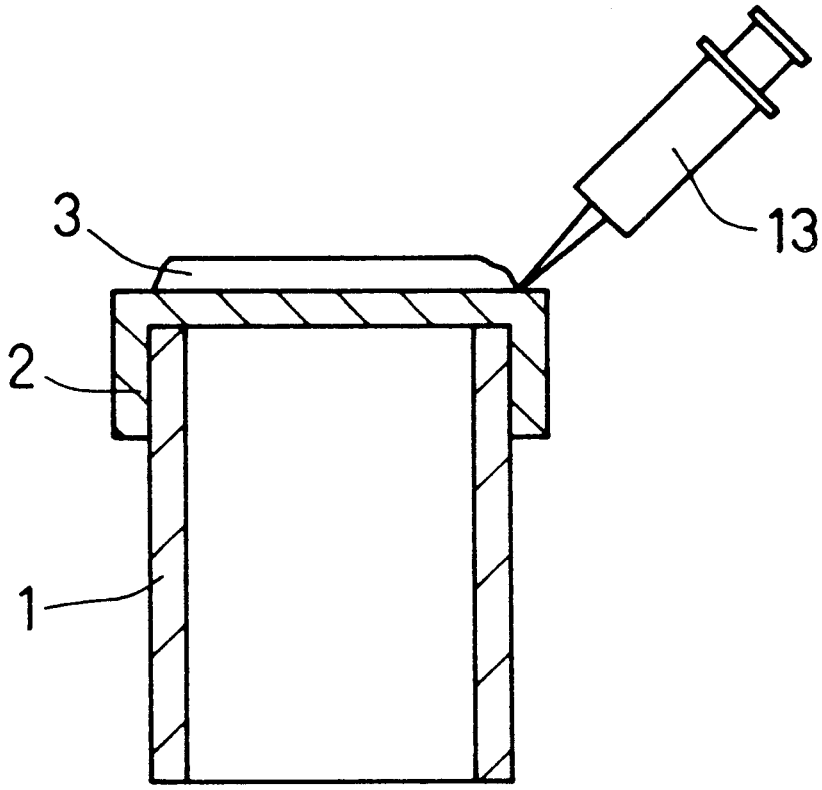
FIG. 3 is a cross-sectional view illustrating a step of a method for manufacturing a cathode in accordance with the second embodiment of the present invention.

If, as a counter-measure, a binder, such as nitrocellulose or ethylcellulose, is injected with an injector 13, such as a syringe, at the face between the electron-emitting layer 3 and the base metal 2, as shown in FIG. 3, after pressing the surface of the electron-emitting layer 3, and the layer 3 is dried again, then the adhesive force between the electron-emitting layer 3 and the base metal 2 can be maintained.

Third Embodiment

Figure 4:
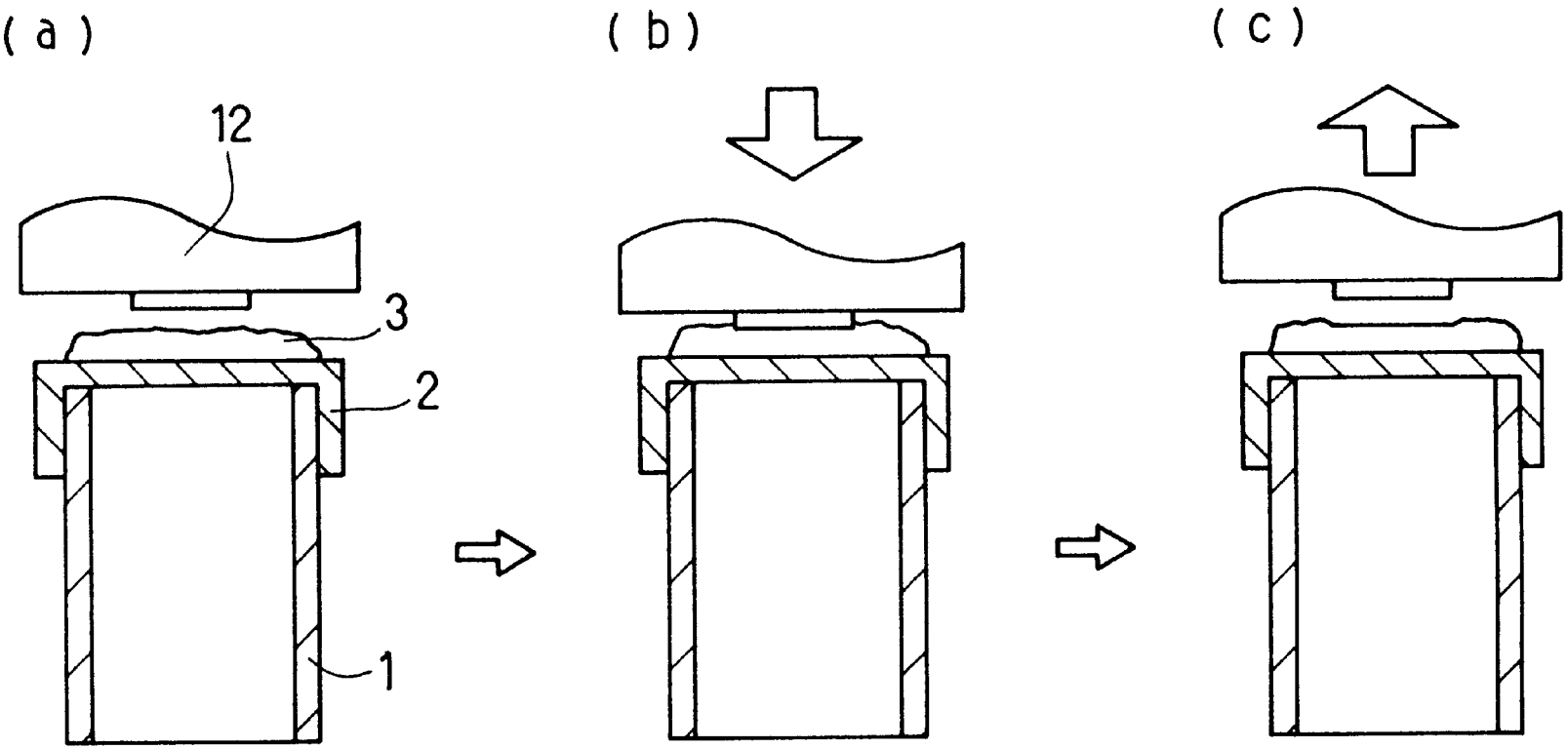
FIGS. 4(*a*)–(*c*) are cross-sectional views illustrating a method for manufacturing a cathode in accordance with the third embodiment of the present invention.

In this embodiment, only a part of the electron-emitting surface comprising an electron-emitting region is flattened, as shown in FIGS. 4(*a*)–(*c*), to prevent the decrease in the adhesive force between the electron-emitting layer 3 and the base metal 2, as in the second embodiment.

Figure 6:
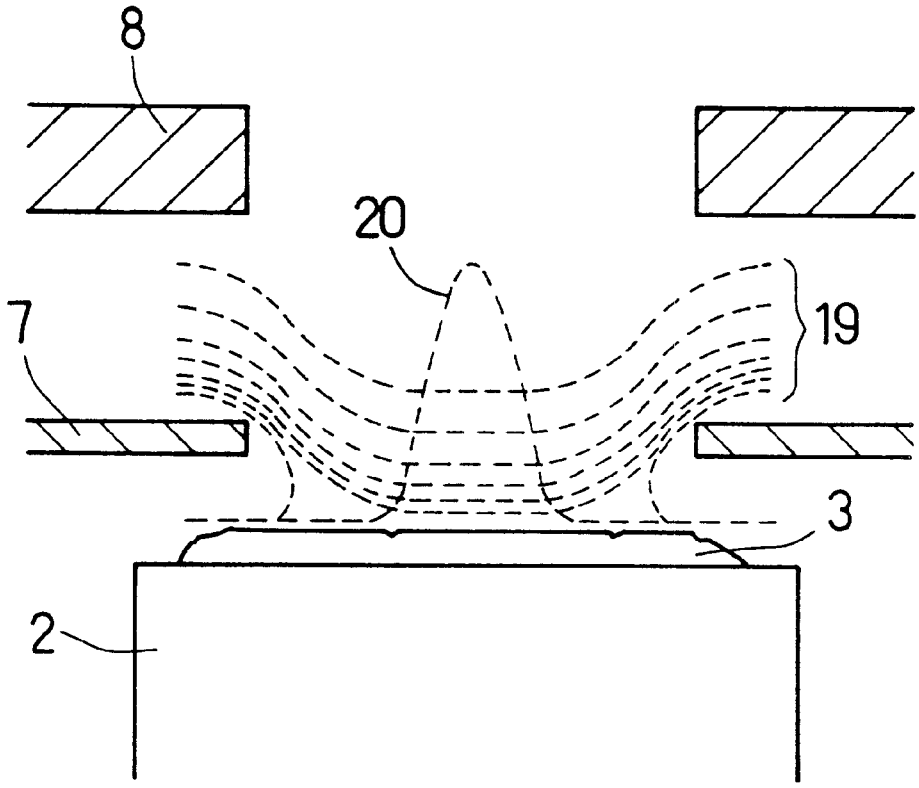
FIG. 6 is a schematic view showing the electrical equipotential distribution near the electron-emitting layer and the current density distribution of the electrons emitted from the electron-emitting surface in a picture tube according to the fourth embodiment of the present invention.

Here, "electron-emitting region" means the region near the lower portion of the electron beam passage of the control electrode 7 of the electron gun, and is the region where electrons are emitted (prominent portion of the current density distribution 20), as shown in FIG. 6.

Because in this embodiment the pressed surface area of the electron-emitting layer 3 is smaller than in the previous embodiments, the force that is applied between the electron-emitting layer 3 and the base metal 2 can be reduced, so that the decrease in the adhesive force between the electron-emitting layer 3 and the base metal is also reduced.

It is preferable that the values for the press stroke S, the surface roughness of the electron-emitting layer 3 after the pressing etc. are the same as in the first embodiment.

Fourth Embodiment

Figure 5:
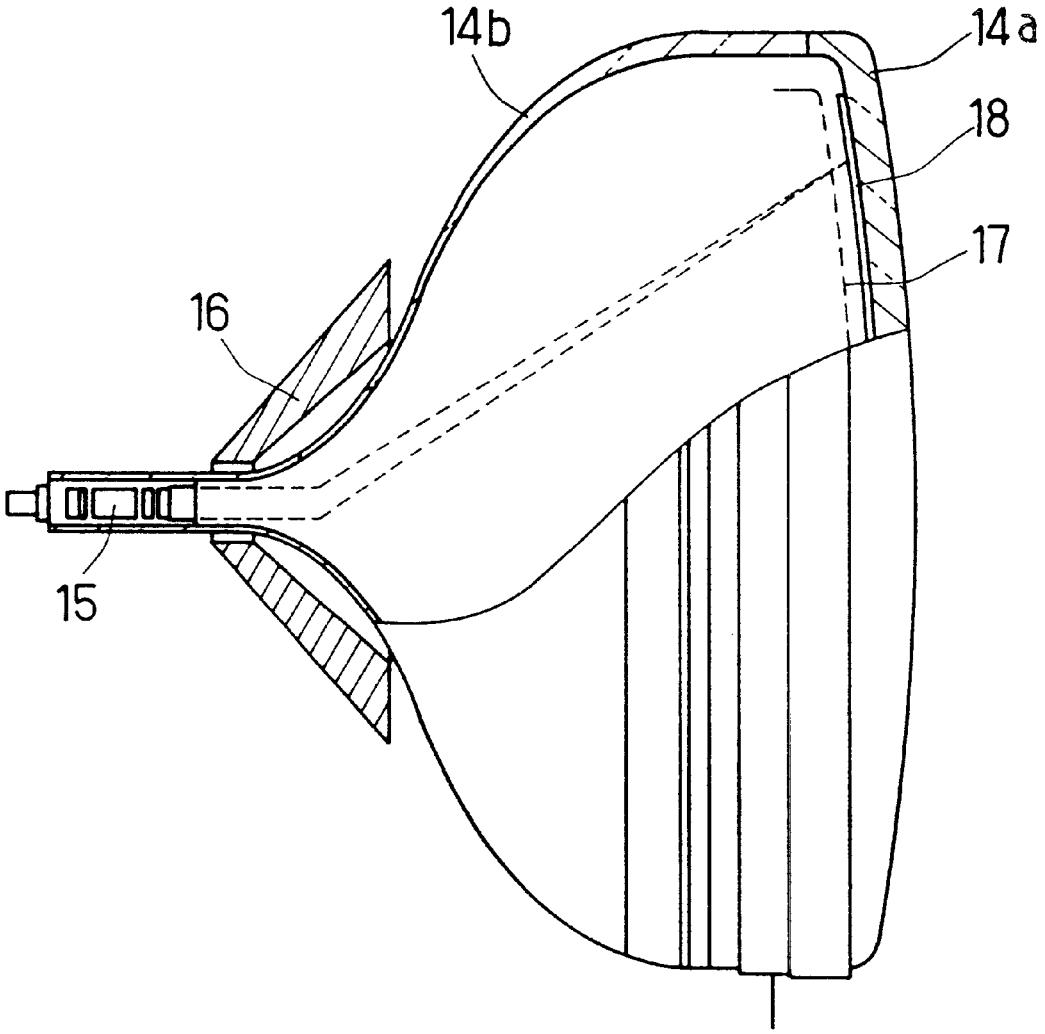
FIG. 5 is a partially cross-sectional view showing a picture tube in accordance with the fourth embodiment of the present invention.

FIG. 5 is a partially cross-sectional view of a picture tube according to a fourth embodiment of the present invention. As is shown in FIG. 5, a picture tube according to the present embodiment comprises basically a face panel 14*a* made of glass, a funnel 14*b* made of glass and connected to the rear of the face panel 14*a*, and an electron gun 15 for emitting an electron beam built into a neck portion of the funnel 14*b*. A deflection yoke 16 for deflecting the electron beam emitted from the electron gun 15 is installed on a peripheral surface of the funnel 14*b*. Phosphorous dots are applied to an inner surface of the face panel 14*b*, forming a phosphorous screen 18. A shadow mask 17 is arranged near the inner surface (phosphorous screen 18) of the face panel 14*a* and substantially parallel to the phosphorous screen 18. The cathode in the first to third embodiments is arranged on one end of the electron gun 15.

FIG. 6 illustrates the electrical equipotential distribution near the electron-emitting surface and the current density distribution of the electrons emitted from the electron-emitting surface in a picture tube according to the present invention. In FIG. 6, the numeral 7 indicates a control electrode and numeral 8 an accelerator electrode.

Due to the electric field 19 formed by the so-called triode portion of base metal 2, control electrode 7, and acceleration electrode 8, electrons are emitted from the electron-emitting surface of the electron-emitting layer 3.

When a cathode structure in accordance with the first to third embodiment is used, the electrons emitted from the surface of the electron-emitting layer 3 will have a smooth current density distribution 20, as shown in FIG. 6.

Figure 7:
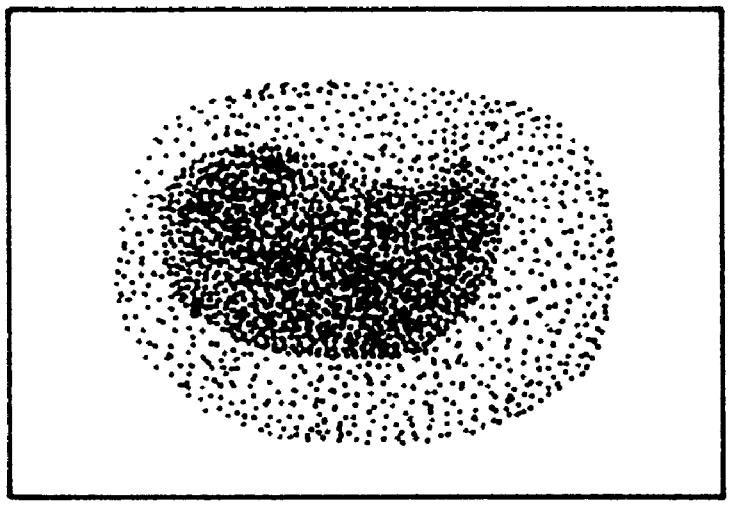
FIG. 7 is an inverted black-and-white representation of a photograph showing the cathode image of a cathode in accordance with the present invention displayed as a halftone image.
Figure 8:
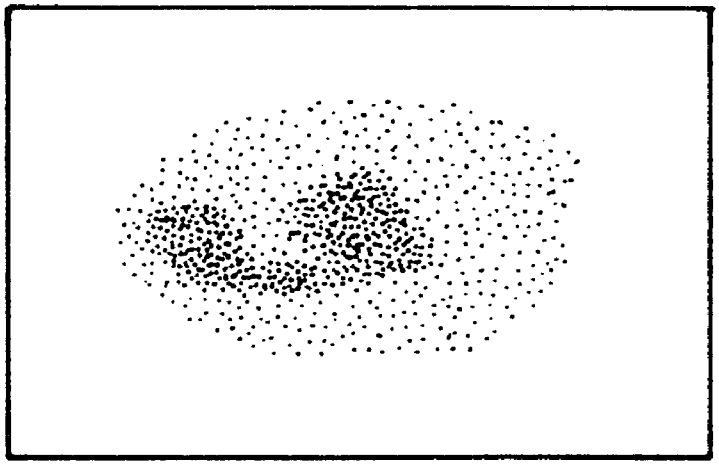
FIG. 8 PRIOR ART
FIG. 8 is inverted black-and-white representation of a photograph showing the cathode image of a conventional cathode displayed as a halftone image.

The current density distribution of the electrons emitted from the surface of such an electron-emitting layer 3 can be observed as the brightness distribution of the cathode image. FIG. 7 illustrates a cathode image of a color picture tube using a cathode structure in accordance with the first to third embodiment. FIG. 8 illustrates a cathode image of a color picture tube using a conventional cathode structure. Here, "cathode image" means the image projecting the current density distribution of the electrons emitted from the cathode surface onto a phosphorous screen using a cathode lens formed between the cathode and the control electrode 7, while the main lens function of the electron gun 15 is turned off. As becomes clear from FIGS. 7 and 8, the cathode image of a conventional color picture tube has a region with bright speckles in its brightness distribution, whereas the brightness distribution of a cathode image of a color picture tube using a cathode in accordance with the first to third embodiment is smooth.

Figure 9:
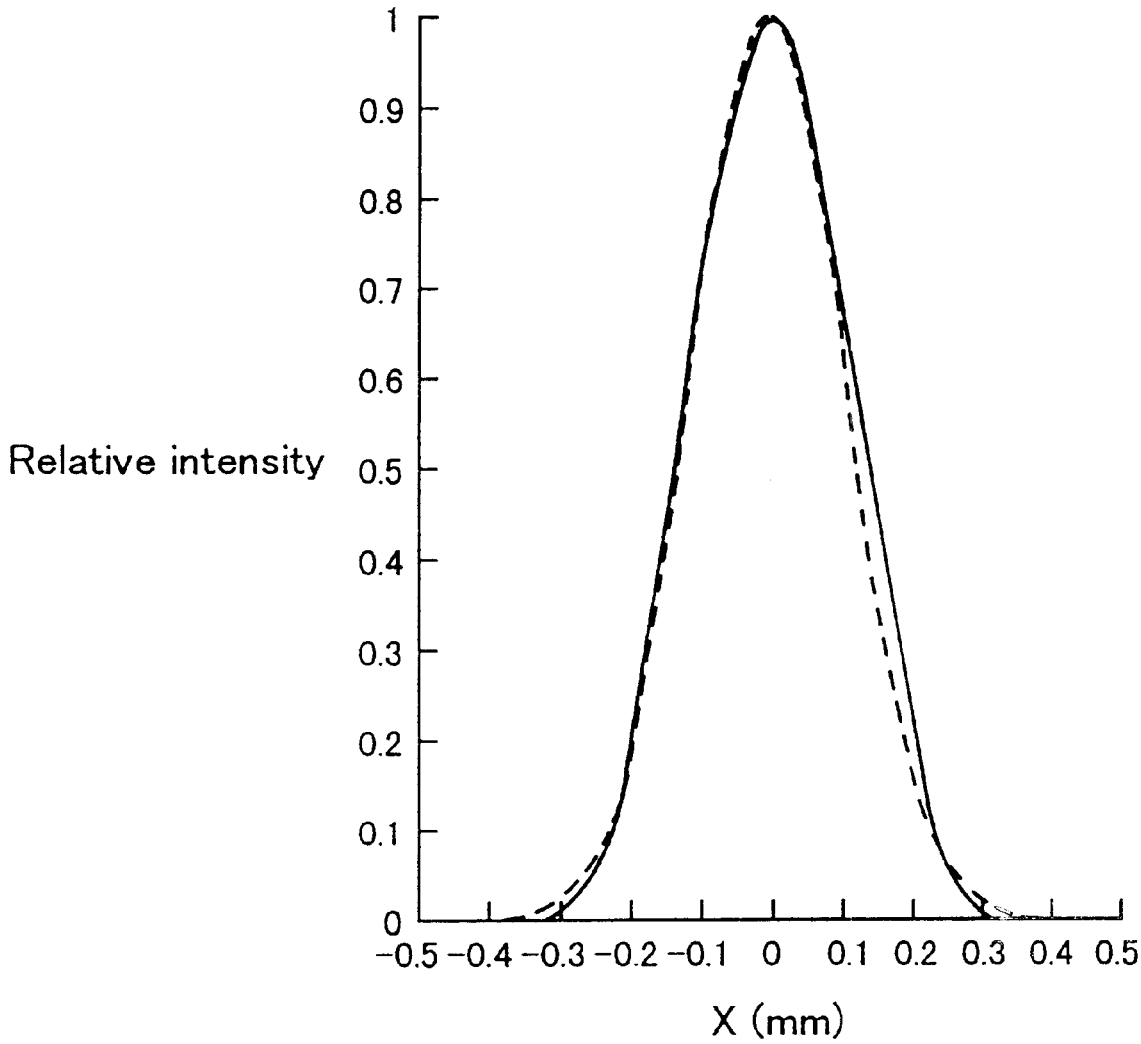
FIG. 9 illustrates the brightness distribution of an electron beam spot on a phosphorous screen of a picture tube in accordance with the present invention.
Figure 10:
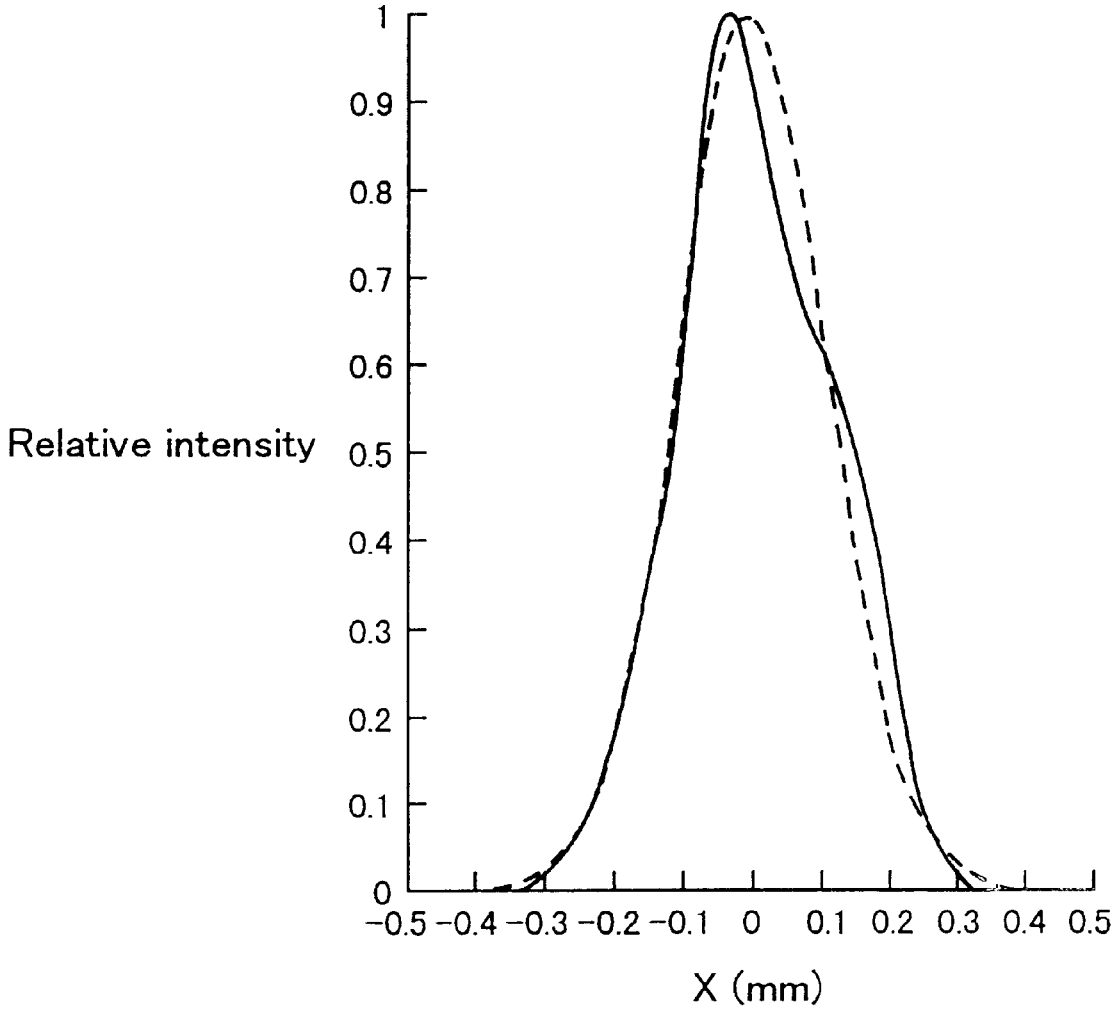
FIG. 10 PRIOR ART
FIG. 10 illustrates the brightness distribution of an electron beam spot in a conventional picture tube.
Figure 11:
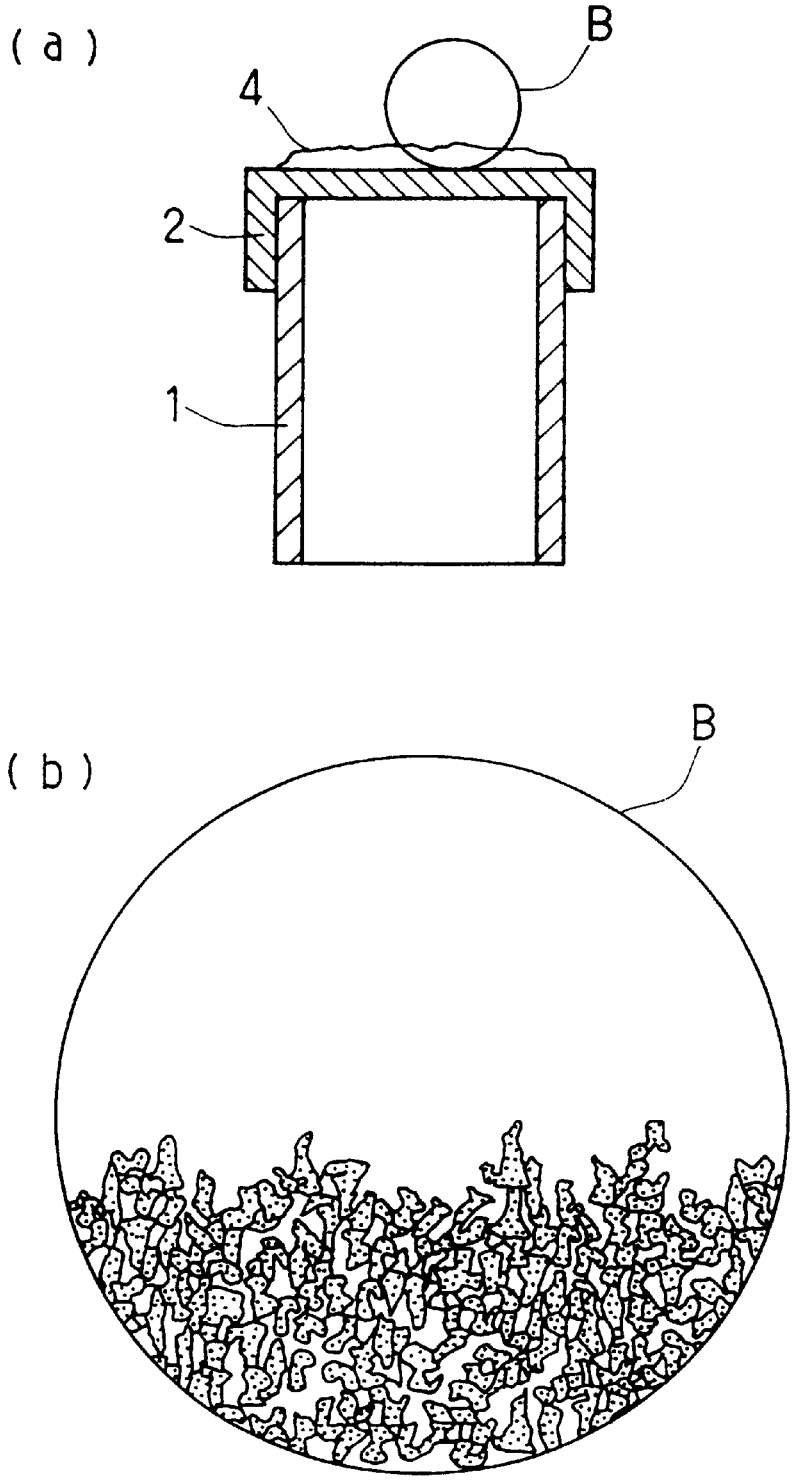
FIG. 11 PRIOR ART
FIG. 11(*a*) is a cross-sectional view showing a conventional cathode.
Figure 12:
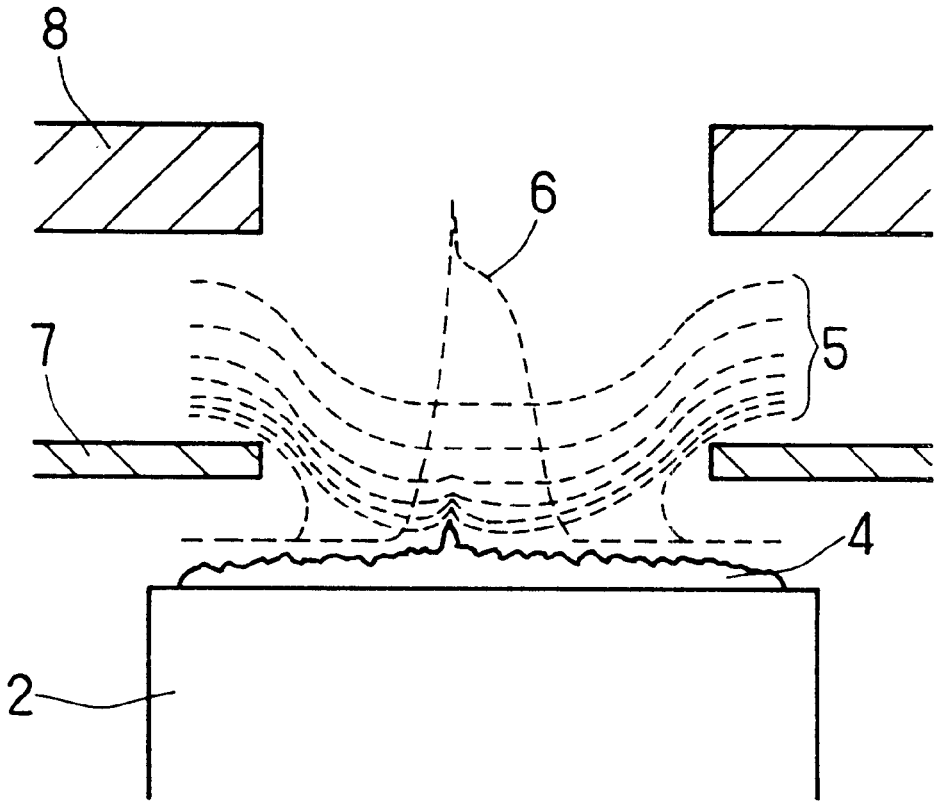
FIG. 12 PRIOR ART
FIG. 12 is a schematic view showing an electrical equipotential distribution near the electron-emitting surface and a current-density distribution of the electrons emitted from the electron-emitting surface in a conventional picture tube.
Figure 13:
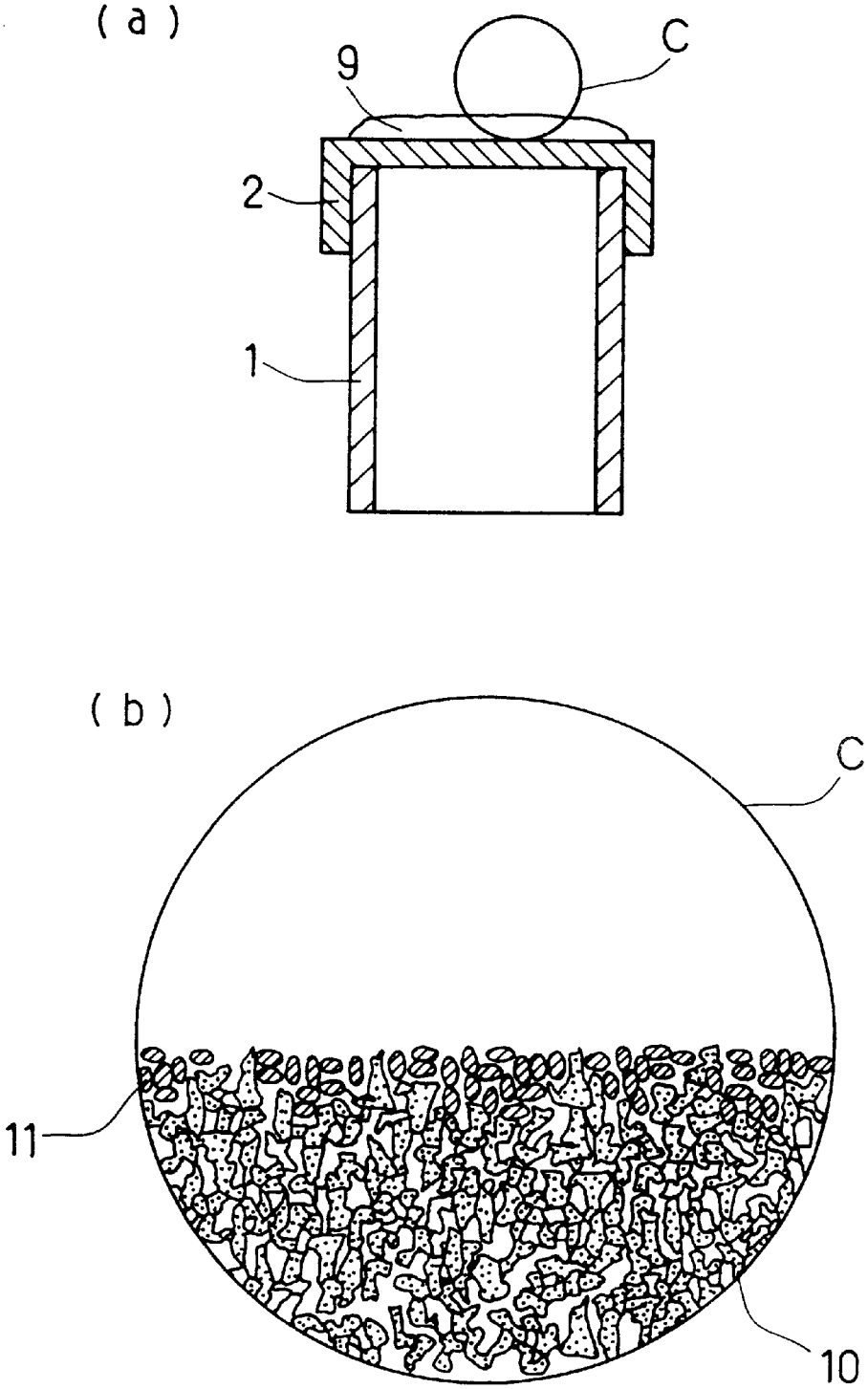
FIG. 13 PRIOR ART
FIG. 13(*a*) is a cross-sectional view showing another example of a conventional cathode.

Moreover, the current density distribution of the electrons emitted from the cathode may be reflected by the electron beam spot formed on the phosphorous screen. FIG. 9 shows the brightness distribution of an electron beam spot in a color picture tube using a cathode structure in accordance with the first to third embodiment (solid line), and FIG. 10 shows the brightness distribution of an electron beam spot in a color picture tube using a conventional cathode structure (solid line). The broken line in FIGS. 9 and 10 is a Gauss approximation at 5% to the relative brightness of the brightness distribution of the electron beam spot.

Whereas distortion occurs in the peak portion of the brightness distribution of an electron beam spot in a color picture tube using a conventional cathode structure, the brightness distribution of the electron beam spot in a color picture tube using a cathode according to the first to third embodiment is smooth, as becomes clear from FIGS. 9 and 10.

It is well-known that the contrast of the moiré caused by interference of the phosphorous dot arrangement and the electron scanning beam increases when there are distortions in the electron beam spot. The moiré contrast calculated from the brightness distribution of the electron beam spot in a color picture tube using a cathode structure according to the present invention (FIG. 9) was Md=0.008, and using a conventional cathode structure was Md=0.054. Since the critical contrast for visibility for humans is Md=0.009, moiré can practically not be observed when a cathode structure in accordance with the present invention is used.

Conventionally, to reduce the moiré contrast, the electron beam spot width at, for example, 5% relative brightness is enlarged, however, this method brings about a reduction of the image resolution. When the moiré contrast is reduced by improving the brightness distribution of the electron beam spot, as in the present invention, the moiré can be prevented without a reduction of the image resolution.

In the previous embodiments, the electron-emitting material was sprayed onto the base metal 2, so that its thickness and density were suitable for optimal electron-emitting characteristics. In this case, to prevent an increase of the electron-emitting layer 3 density due to a small reduction of the film thickness when the electron-emitting layer 3 is pressed, the film thickness can be sprayed on just a little too thick, or in other words with just a little too low density, so that the electron-emitting layer 3 has suitable thickness and density after the pressing.

Other methods for mechanically flattening the surface of the electron-emitting layer 3 instead of pressing include for example rolling.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A method for manufacturing a cathode comprising a base metal and an electron-emitting layer of electron-emitting material formed on the base metal comprises the steps of:

applying an electron-emitting material onto a base metal to form an electron-emitting layer;

drying the electron-emitting layer;

mechanically flattening an electron-emitting surface of the dried electron-emitting layer by compacting; and injecting a binder between the base metal and the electron-emitting layer, after flattening the electron-emitting surface.

2. The method according to claim 1, wherein the compacting comprises pressing the surface of the electron-emitting layer with a press die.

3. The method according to claim 1, wherein the electron-emitting surface is mechanically-flattened with a press die, and a surface roughness of the press die, determined as a maximum height $R_y$ in JIS B 0601, is not more than 2 $\mu$m.

4. A method for manufacturing a cathode comprising a base metal and an electron-emitting layer of electron-emitting material formed on the base metal, comprising the steps of:

applying an electron-emitting material onto a base metal to form an electron-emitting layer;

drying the electron-emitting layer; and mechanically flattening an electron-emitting surface of the dried electron-emitting layer by compacting; wherein the electron-emitting surface is mechanically-flattened with a press die, and a surface roughness of the press die, determined as a maximum height $R_y$ JIS B 0601, is not more than 2 $\mu$m.

5. The method according to claim 4, wherein the compacting comprises pressing the surface of the electron-emitting layer with a press die.

* * * * *